US008683748B2

(12) United States Patent
Arch

(10) Patent No.: US 8,683,748 B2
(45) Date of Patent: Apr. 1, 2014

(54) ROOF PARAPET SYSTEM

(76) Inventor: Garth Arch, Grand Cayman (KY)

( * ) Notice: Subject to any disclaimer, the term of this patent is extended or adjusted under 35 U.S.C. 154(b) by 0 days.

(21) Appl. No.: 13/270,343

(22) Filed: Oct. 11, 2011

(65) Prior Publication Data

US 2012/0085039 A1 Apr. 12, 2012

Related U.S. Application Data

(60) Provisional application No. 61/391,721, filed on Oct. 11, 2010.

(51) Int. Cl.
*E04F 19/00* (2006.01)

(52) U.S. Cl.
USPC ..... 52/27; 52/96; 52/97

(58) Field of Classification Search
USPC ..... 52/27, 173.3, 11, 60, 96, 97, 105, 741.4
See application file for complete search history.

(56) References Cited

U.S. PATENT DOCUMENTS

| | | | | | |
|---|---|---|---|---|---|
| 2,271,081 | A | * | 1/1942 | Layton | 52/12 |
| 3,053,393 | A | * | 9/1962 | McLean | 210/474 |
| 3,280,524 | A | | 10/1966 | Hull | |
| 3,420,378 | A | * | 1/1969 | Turner | 210/474 |
| 3,592,721 | A | * | 7/1971 | Formanek | 428/121 |
| 3,667,717 | A | * | 6/1972 | Fasth | 248/48.2 |
| 3,740,787 | A | * | 6/1973 | Bowermaster | 15/105 |
| 3,855,132 | A | * | 12/1974 | Dugan | 210/455 |
| 4,032,456 | A | * | 6/1977 | Berce | 210/474 |
| 4,395,852 | A | * | 8/1983 | Tang | 52/12 |
| 4,447,994 | A | * | 5/1984 | Garneau | 52/11 |
| 4,745,657 | A | * | 5/1988 | Faye | 16/226 |
| 4,765,101 | A | * | 8/1988 | Wolf | 52/12 |
| 4,769,526 | A | * | 9/1988 | Taouil | 219/213 |
| 4,905,427 | A | * | 3/1990 | McPhalen | 52/12 |
| 5,189,849 | A | * | 3/1993 | Collins | 52/12 |
| 5,339,575 | A | * | 8/1994 | Kuhns | 52/12 |
| 5,383,310 | A | * | 1/1995 | Sapia | 52/12 |
| 5,406,754 | A | * | 4/1995 | Cosby | 52/12 |
| 5,459,965 | A | * | 10/1995 | Meckstroth | 52/12 |
| 5,471,798 | A | * | 12/1995 | Kuhns | 52/12 |
| 5,557,891 | A | * | 9/1996 | Albracht | 52/12 |
| 5,617,678 | A | * | 4/1997 | Morandin et al. | 52/11 |
| 5,619,825 | A | * | 4/1997 | Leroney et al. | 52/12 |
| 5,640,809 | A | * | 6/1997 | Iannelli | 52/12 |
| 5,862,631 | A | * | 1/1999 | Attaway et al. | 52/11 |
| 5,953,861 | A | * | 9/1999 | Podgwaite | 52/11 |
| 6,035,587 | A | * | 3/2000 | Dressler | 52/97 |
| 6,067,755 | A | * | 5/2000 | Maanum | 52/12 |
| 6,161,338 | A | * | 12/2000 | Kuhns | 52/12 |
| 6,212,829 | B1 | * | 4/2001 | Webb et al. | 52/96 |
| 6,227,963 | B1 | * | 5/2001 | Headrick | 454/365 |
| 6,293,054 | B1 | * | 9/2001 | Cangialosi | 52/12 |
| 6,314,685 | B1 | * | 11/2001 | Sullivan | 52/12 |
| 6,412,228 | B1 | * | 7/2002 | Meckstroth | 52/12 |
| 6,463,700 | B2 | * | 10/2002 | Davis | 52/12 |
| 6,493,994 | B1 | * | 12/2002 | Lucas | 52/12 |
| 6,601,348 | B2 | | 8/2003 | Banks et al. | |

(Continued)

*Primary Examiner* — Joshua J Michener
*Assistant Examiner* — James Ference
(74) *Attorney, Agent, or Firm* — Christopher & Weisberg, P.A.

(57) ABSTRACT

A wind mitigation system is disclosed, including a panel engageable with a drain channel of a roof, the panel dimensioned to extend above a top edge defined by the drain channel, wherein the panel defines a plurality of openings; and a structural support member coupled to the panel, the structural support member providing increased rigidity of the panel.

13 Claims, 4 Drawing Sheets

(56) References Cited

U.S. PATENT DOCUMENTS

| | | | | |
|---|---|---|---|---|
| 6,606,828 | B1 | 8/2003 | Lin et al. | |
| 6,745,516 | B2 * | 6/2004 | Beyers | 52/12 |
| 6,786,018 | B2 | 9/2004 | Webb et al. | |
| 6,932,911 | B1 * | 8/2005 | Groth et al. | 52/12 |
| 6,944,992 | B2 * | 9/2005 | Brochu | 52/12 |
| 7,104,011 | B1 * | 9/2006 | Knight | 52/12 |
| 7,104,012 | B1 * | 9/2006 | Bayram | 52/12 |
| 7,278,239 | B1 * | 10/2007 | West | 52/12 |
| 7,303,687 | B2 * | 12/2007 | Groth et al. | 52/12 |
| 7,448,167 | B2 * | 11/2008 | Bachman | 52/12 |
| 7,487,618 | B2 | 2/2009 | Lin | |
| 7,581,356 | B1 * | 9/2009 | Balkum et al. | 52/12 |
| 7,726,076 | B2 * | 6/2010 | Staub | 52/11 |
| 7,726,077 | B2 * | 6/2010 | Dowling et al. | 52/12 |
| 7,752,812 | B2 * | 7/2010 | Knudson et al. | 52/12 |
| 8,069,617 | B2 * | 12/2011 | Wootton | 52/12 |
| 2002/0073631 | A1 * | 6/2002 | Baker | 52/12 |
| 2003/0070366 | A1 * | 4/2003 | Beyers | 52/12 |
| 2004/0040220 | A1 * | 3/2004 | Baker | 52/12 |
| 2004/0250478 | A1 * | 12/2004 | McDonald et al. | 52/11 |
| 2005/0115158 | A1 * | 6/2005 | Brown | 52/11 |
| 2005/0138866 | A1 * | 6/2005 | Kim | 52/12 |
| 2005/0172565 | A1 * | 8/2005 | Riley et al. | 52/12 |
| 2006/0117672 | A1 * | 6/2006 | Kurple et al. | 52/12 |
| 2006/0196124 | A1 * | 9/2006 | Bachman | 52/12 |
| 2006/0201068 | A1 * | 9/2006 | Shane | 52/11 |
| 2006/0213129 | A1 * | 9/2006 | Bachman | 52/11 |
| 2006/0277831 | A1 * | 12/2006 | Bachman | 52/11 |
| 2007/0214731 | A1 * | 9/2007 | Bachman et al. | 52/12 |
| 2009/0139180 | A1 * | 6/2009 | Kehs et al. | 52/741.3 |
| 2009/0188173 | A1 * | 7/2009 | Ealer, Sr. | 52/12 |
| 2009/0229192 | A1 * | 9/2009 | McNeish et al. | 52/16 |
| 2009/0288349 | A1 * | 11/2009 | Wootton | 52/12 |
| 2010/0281785 | A1 * | 11/2010 | Kaiser et al. | 52/24 |

* cited by examiner

ROOF PARAPET SYSTEM

CROSS-REFERENCE TO RELATED APPLICATION

This application is related to and claims priority to U.S. Provisional Application Ser. No. 61/391,721, filed Oct. 11, 2010, entitled ROOF PARAPET SYSTEM, the entirety of which is incorporated herein by reference.

STATEMENT REGARDING FEDERALLY SPONSORED RESEARCH OR DEVELOPMENT n/a

FIELD OF THE INVENTION

The present invention relates to systems and methods of use thereof for reducing roof susceptibility to undesired suction forces occurring during high winds and turbulent weather.

BACKGROUND OF THE INVENTION

Property losses due to windstorms cost billions of dollars annually around the world. Roof covering failures, in particular, routinely occur during the increased wind velocities experienced during hurricanes and other violent storms. High winds result in increased suction forces on a roof that can severely damage or completely destroy the roof. Of course, once the roof of a structure is compromised, or even worse, completely detached and blown away from the structure, the remaining building structure, its interior, contents, and even inhabitants are exposed to further damage or injury from inclement weather.

The uplift force on the roof occurs largely due to vortices that form in the separated air/wind flow along roof edges and particularly at the corners of a roof. Disrupting the creation of unwanted rooftop vortices is thus desirable, and there is a need for cost-effective structures and methods that can mitigate the uplift effect caused by vortices created due to incident high winds and that can further readily integrate with existing structures without the need for significant architectural or structural modifications.

SUMMARY OF THE INVENTION

The present invention advantageously provides cost-effective structures and methods that mitigate the uplift effect caused by vortices created due to incident high winds and that can further readily integrate with existing structures without the need for significant architectural or structural modifications. For example, a roof parapet system is provided that generally includes a parapet body or panel positionable in or about a drain channel or gutter coupled to an edge or fascia of a roof. The parapet body defines a plurality of openings to reduce or otherwise mitigate the development of vortices and resulting uplift on a roof during severe windstorms. The parapet panel may have an adjustable height and length, and be slidably positioned on or about the drain channel. The system may further include one or more structural support members engageable with the parapet panel and/or the drain channel to aid in the secure positioning and anchoring of the parapet body either within an interior or exterior of the drain channel and/or the roof itself.

A wind mitigation system is disclosed, including a panel engageable with a drain channel of a roof, the panel dimensioned to extend above a top edge defined by the drain channel, wherein the panel defines a plurality of openings; and a structural support member coupled to the panel, the structural support member providing increased rigidity of the panel. The panel may define a first segment movable with respect to a second segment, and the first segment may be pivotable with respect to the second segment. The structural support member may be substantially perpendicular to the panel. The plurality of openings may have an area between approximately 15% to 25% of a total area of the panel. The system may include a plurality of anchors engageable with at least two of the panel, drain channel, and structural support member. The structural support member may be dimensioned to fit within the drain channel without obstructing fluid flow through the drain channel and/or the panel may be dimensioned to extend above the top edge of the drain channel between approximately 6 inches and approximately 10 inches. The panel may be part of a substantially "U"-shaped insert positionable within the drain channel.

A parapet device engageable with a drain channel of a roof is disclosed, including a first wall positionable within the drain channel and dimensioned to extend above a top edge of the drain channel, the first wall defining a plurality of apertures; a second wall extending substantially perpendicularly to the first wall; and a third wall spaced from the first wall and extending substantially perpendicularly to the second wall. The device may include a structural support element coupled to the first and third walls, where at least a portion of the structural support element is spaced from the second wall to allow fluid flow therebetween. The first wall may define a first segment movable with respect to a second segment, and the first segment may be pivotable about the second segment in a direction towards the third wall.

A method of mitigating wind effects on a roof, the roof including a drain channel attached thereto, is disclosed, including coupling a panel to the drain channel such that the panel extends above an upper edge of the drain channel, wherein the panel defines a plurality of apertures therein. The panel may be spaced apart from the roof. The method may include attaching a structural support member to the panel and at least one of the drain channel or roof, where the structural support member may be positioned between the panel and the roof. The method may include pivoting a first segment of the panel about a second segment of the panel. The panel may be part of a substantially "U"-shaped insert positionable within the drain channel.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
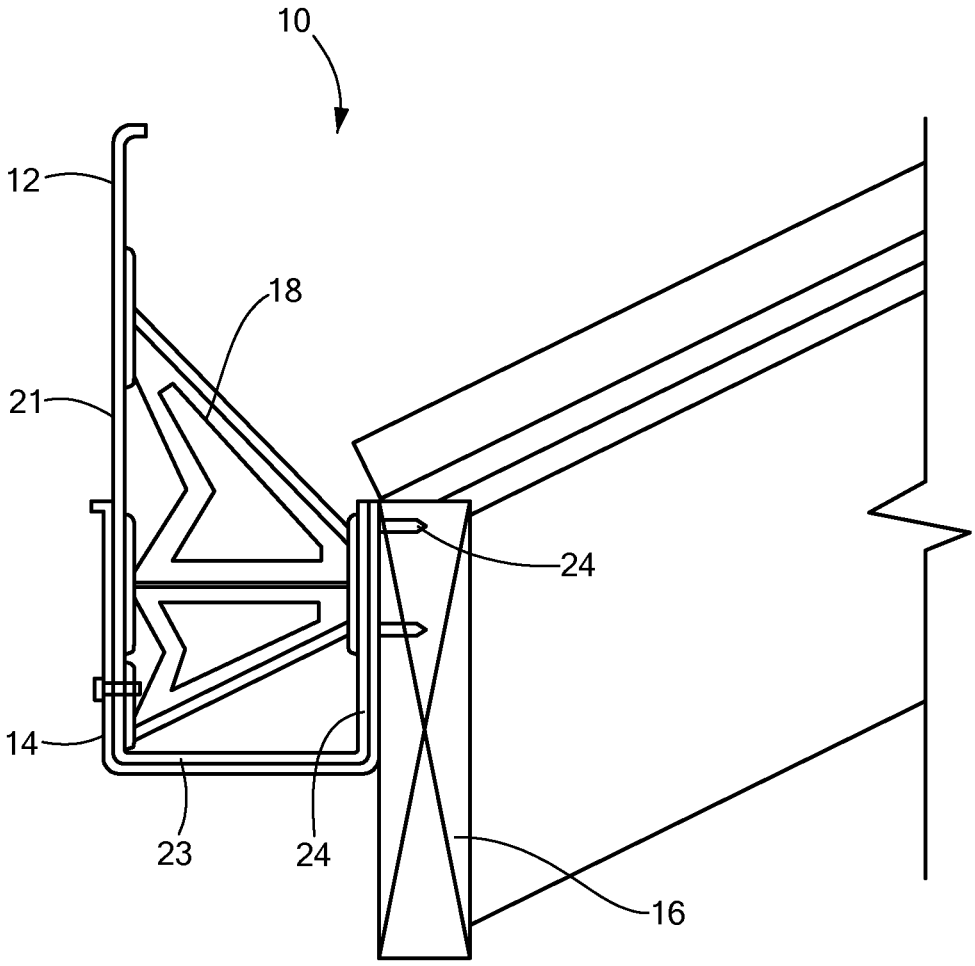
FIG. 1 is a side view of an example of a roof parapet system constructed in accordance with the principles of the present disclosure.
Figure 2:
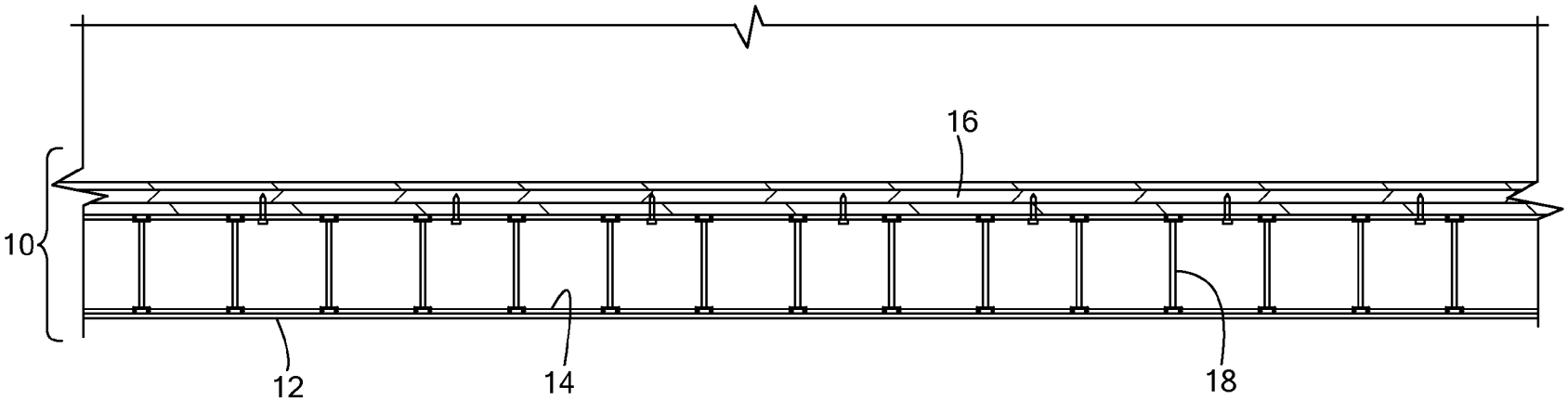
FIG. 2 is a top view of the roof parapet system of FIG. 1.

The present invention advantageously provides cost-effective structures and methods that mitigate the uplift effect caused by vortices created due to incident high winds and that can further readily integrate with existing structures without the need for significant architectural or structural modifications. In particular and now referring to the figures where like reference designators refer to like components, there is shown a suction force or wind force mitigating, roof parapet system generally designated as 10. The roof parapet system 10 generally includes a parapet body or panel 12 positionable in or about a drain channel or gutter 14 coupled to an edge of a roof 16. The parapet body or panel may also be directly attached to a fascia or outer panel of a roof 16 or portion of the structure itself to extend above the roofline. The system 10 may further include one or more structural support members 18 engageable with the parapet panel 12 and/or the drain channel 14 to aid in the secure positioning and anchoring of the parapet body 12 with the drain channel 14 and/or the roof (or roof fascia) 16 itself, as described in more detail below.

Figure 3:
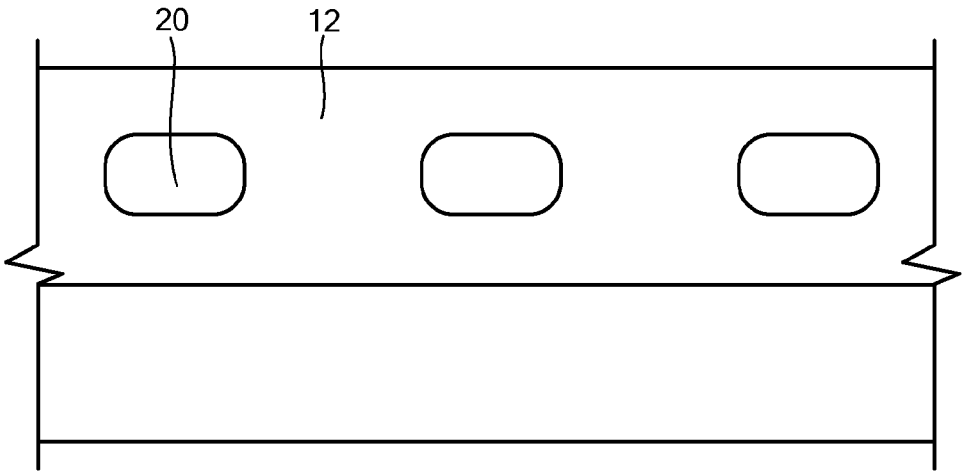
FIG. 3 is another side view of the roof parapet system of FIG. 1.

The parapet body or panel 12 may generally define a rectangular shape that is at least partially positionable within or otherwise engageable to the drain channel 14 such that a portion of the parapet panel 12 extends above an edge defined by an exterior wall forming the drain channel 14. For example, the drain channel 14 may have a wall height (and corresponding channel depth) of between approximately 3 inches to 10 inches. The parapet body 12 may have sufficient height to extend above the drain channel 14 by approximately 6 to 10 inches, for example. Turning now to FIG. 3, the parapet body 12 defines a plurality of openings or apertures 20 along its length. The openings may generally be vertically centered within the portion of the parapet body 12 extending above the drain channel 14, and may be sized and spaced to optimize disruption of the formation of vortices along the roof edge, thus mitigating the uplift forces acting on the roof during a storm or inclement weather. The openings may further have an area of approximately 15% to 25% of the total area of the parapet panel 12. For example, in a section of the parapet panel 12 measuring approximately 8 inches in height and 8 inches in length, an opening in that section may have a diameter of approximately 4 inches. In this particular example, the 4 inch diameter opening thus has an area of $\pi*(2\text{ inches})^2=12.56\text{ in}^2$, while the entire 8 inch×8 inch portion has an area of 64 $\text{in}^2$. The percentage of the area of the opening to the total area is thus 12.56/64=0.196, or approximately 20%.

The parapet panel 12 may constitute a portion of an insert positionable within the drain channel 14. For example, the parapet panel 12 may be defined by a first wall 21 that is connected to or extending from a second wall 23, where the second wall 23 is substantially perpendicular to the first wall and positionable along a floor or bottom surface of the drain channel 14. A third wall 24 may then extend substantially perpendicularly to the second wall 23 opposite of the first wall 21 to define a substantially "U"-shaped cross section matable with and complimentary to a profile of the drain channel 14.

Figure 4:
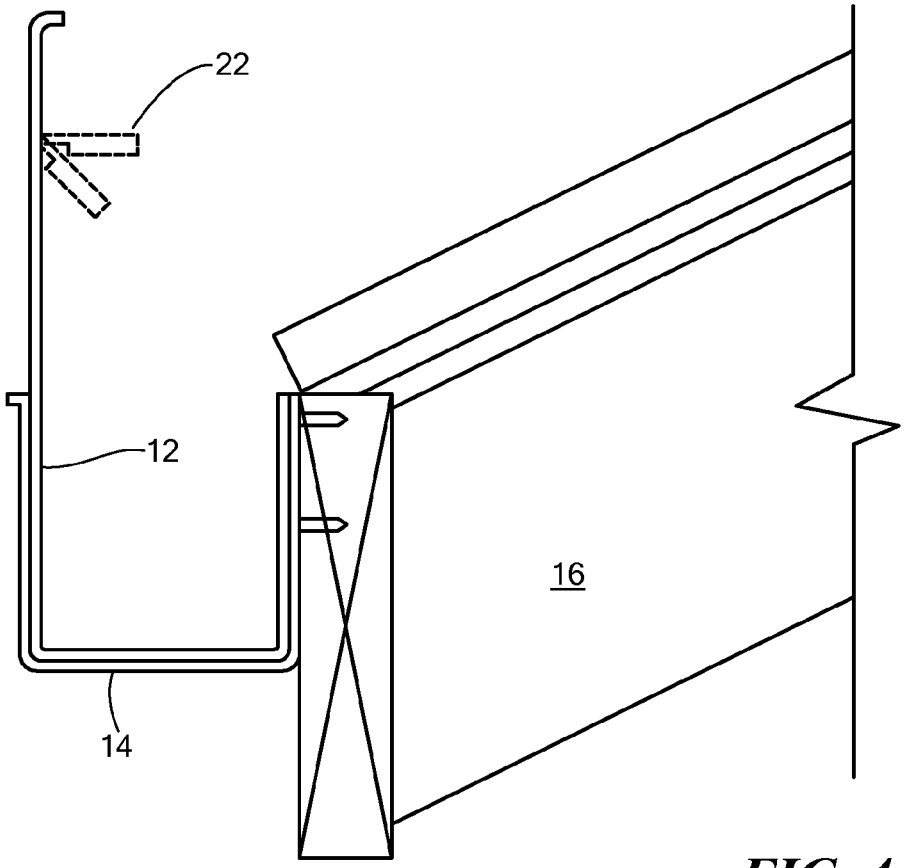
FIG. 4 is a side view of an example of a roof parapet system having a pivotable segment constructed in accordance with the principles of the present disclosure.

Turning now to FIG. 4, the parapet panel 12 may include a foldable or pivotable segment 22 on an upper portion of the panel 12 that can fold or pivot downwards to adjust the overall height of the panel 12 extending above the drain channel 14. Having an adjustable height may allow the parapet panel to be easily modified when expecting increasingly severe weather (e.g., extending height) versus typical, less severe wind (e.g., reducing panel height). As an alternative to folding or pivoting a portion of panel 12 on itself, the height may also be adjustable through telescoping mechanisms, a series of extending panels slidably positioned adjacent to one another, and the like. In addition to having an adjustable height, the parapet panel 12 may be slidably engaged to the drain channel 14 and/or other parapet panels such that one or more of the parapet panels 12 may be movably positioned along the length of the drain channel 14. The slidable nature of the panels may allow ease of access to portions of the drain channel itself for cleaning, maintenance, etc.

The parapet panel 12 may be constructed from one or more materials providing sufficient rigidity to allow the panel to be securely fastened to the drain channel 14 and/or roof 16 while also resisting or being able to withstand turbulent, high velocity winds. Such materials may include plastics or polymers such as polycarbonate, as well as metals such as galvanized steel or sheet metal, or mixtures and combinations thereof.

The roof parapet system 10 may further include one or more of the support members 18 that couple to the parapet body 12 and or/the drain channel 14 to aid in securing the parapet panel 12 to the drain channel 14. The support members 18 may be placed substantially perpendicularly to the parapet panel 12 and/or a wall of the drain channel 14, and may also be positioned substantially parallel to the parapet panel to reinforce one or more perpendicular support members. For example, the support member 18 may include a sufficiently rigid component extending between the first wall 21 and/or portion of the parapet panel 12 that is spaced from an edge of the roof 16 to an interior portion or wall of the drain channel 14 (or third wall 24) that is closer to the roof and/or the roof 16 itself. The support members 18 may be spaced along the length of the drain channel 14 to securely affix one or more parapet bodies 12 to the drain channel 14. In addition, the support members 18 may include an adjustable length through a telescoping mechanism or the like so that a single support member may be adjustably suited to fit any number of available or previously-installed drain channels 18 having varying dimensions or widths. At least a portion of the support member(s) 18 may be spaced from an underside of the drain channel and/or the second wall 23 so that fluid flow through the drain channel is substantially unobstructed when the support member 18 is in place. It is also contemplated that the support member 18 may define one or more openings therethrough to reduce any interference with rain runoff flowing through the drain channel 14.

The parapet body 12 and/or the support member 18 may be attached to the drain channel 14 by one or more fasteners 26 such as screws, bolts, or the like at one or more attachment points on the drain channel 14 or roof 16 to reduce the likelihood of loosening or coming apart under the stresses experienced during a windstorm or other severe environmental conditions.

Figure 5:
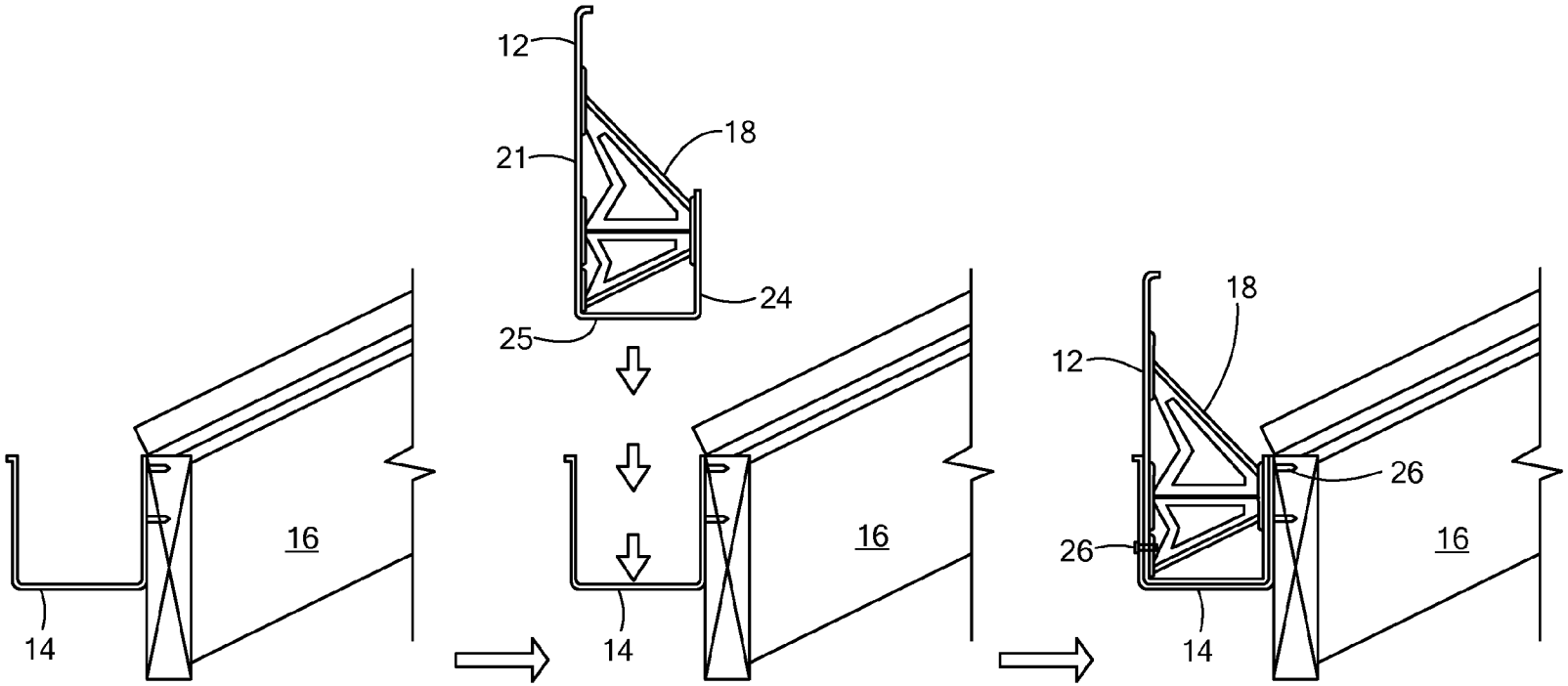
FIG. 5 is illustrates an exemplary method of installation of an example of a roof parapet system constructed in accordance with the principles of the present disclosure.

Turning now to FIG. 5, an exemplary method of installation of the roof parapet system 10 is shown. In particular, the parapet body 12 and support member 18 are positioned within a drain channel 14 that has been previously attached to a roof 16 through one or more anchors, screws, or the like. Once the parapet body 12 and support member are desirably positioned, additional anchors are added to secure the attachment of the components to the system. Of note, while the parapet body 12 and the support member 18 are illustrated as fitting within a portion of the drain channel 14, it is contemplated that the parapet body may be coupled to an exterior portion of the drain channel 14 with the support member extending underneath the drain channel to secure the parapet panel 12 to the drain channel 14 and/or directly to the roof 16. Such placement may be facilitated by a clip (not shown) or other fastener allowing for the secure engagement between the parapet panel 12; the drain channel 14; and/or the roof 16.

In sum, the present disclosure relates to the prevention or reduction of wind suction forces induced on the roof and allows for an effective, cost-effective, readily-installed system for mitigating wind suction without requiring costly and time-consuming alterations to a building's architecture. This novel system reduces or may eliminate the amplification of pressure drops caused by wind gusts flowing over the rooftop. In addition, the systems and methods of use thereof provide potential wind force mitigation without substantially interfering with or obstructing fluid drainage coming off the roof and into the drain channels, which may then direct the runoff to a desired area.

It will be appreciated by persons skilled in the art that the present invention is not limited to what has been particularly shown and described herein above. In addition, unless mention was made above to the contrary, it should be noted that all of the accompanying drawings are not to scale and any dimensions indicated on the accompanying figures are for illustration purposes only. A variety of modifications and variations are possible in light of the above teachings without departing from the scope and spirit of the invention, which is limited only by the following claims.

What is claimed is:

1. A wind mitigation system for a roof having a drain channel, the drain channel having a top edge, the wind mitigation system comprising:

a panel engagable with the drain channel, the panel including:

a first part configured to extend above the top edge when the panel engages the drain channel, the first part defining a plurality of openings, a second part adjacent to the first part, the second part being disposed at least substantially perpendicular to the first part, and a third part adjacent to the second part, the third part being disposed at least substantially perpendicular to the second part, the third part configured to be at least substantially parallel to the first part, the second part and the third part configured to be below the top edge defined by the drain channel when the panel engages the drain channel; and a structural support member, the structural support member including:

a first securing part configured to be affixed to the first part of the panel, and a second securing part configured to be affixed to the third part of the panel, the structural support member configured to provide increased rigidity of the panel.

2. The system of claim 1, wherein the first part of the panel defines a first segment and a second segment, the first segment configured to be movable with respect to the second segment.

3. The system of claim 2, wherein the first part further comprises:

a pivot, wherein the first segment is configured to rotate about the pivot with respect to the second segment.

4. The system of claim 1, wherein the structural support member is substantially perpendicular to the panel.

5. The system of claim 1, wherein the plurality of openings have an area between approximately 15% to 25% of a total area of the first part of the panel.

6. The system of claim 1, further comprising a plurality of anchors engageable with at least two of the panel, drain channel, and structural support member.

7. The system of claim 1, wherein the structural support member is configured to fit within the drain channel without obstructing fluid flow through the drain channel.

8. The system of claim 1, wherein the first part of the panel is configured to extend above the top edge of the drain channel between approximately 6 inches and approximately 10 inches.

9. The system of claim 1, wherein the panel is part of a substantially "U"-shaped insert positionable within the drain channel.

10. A parapet device engageable with a drain channel of a roof, the drain channel having a top edge, the parapet device comprising:

a first wall positionable within the drain channel and configured to extend above the top edge of the drain channel when the parapet device engages the drain channel, the first wall defining a plurality of apertures;

a second wall extending at least substantially perpendicularly to the first wall and configured to engage a bottom part of the drain channel; and a third wall spaced from the first wall and extending at least substantially perpendicularly to the second wall, the third wall configured to be at least substantially parallel to the first wall, the second wall and the third wall configured to be below the top edge defined by the drain channel when the parapet device engages the drain channel; and a structural support member, the structural support member including:

a first securing part configured to be affixed to the first wall, and a second securing part configured to be affixed to the third wall, the structural support member configured to provide increased rigidity of the parapet device.

11. The device of claim 10, wherein at least a portion of the structural support element member is spaced from the second wall to allow fluid flow therebetween.

12. The device of claim 10, wherein the first wall defines a first segment movable with respect to a second segment.

13. The device of claim 12, wherein the first segment is pivotable about the second segment in a direction towards the third wall.

* * * * *